US006167938B1

(12) United States Patent
Chien

(10) Patent No.: US 6,167,938 B1
(45) Date of Patent: Jan. 2, 2001

(54) BLIND WITH ANGLED SLATS HAVING UNEQUAL WINGS

(76) Inventor: Jui-Wen Chien, 115 Ning Sia R.D., Taipei (TW)

( * ) Notice: Under 35 U.S.C. 154(b), the term of this patent shall be extended for 0 days.

(21) Appl. No.: 09/382,916

(22) Filed: Aug. 25, 1999

(51) Int. Cl.[7] ..... E06B 9/30

(52) U.S. Cl. ..... 160/168.1 R; 160/176.1 R; 160/178.1 R; 160/236

(58) Field of Search ..... 160/168.1 R, 176.1 R, 160/178.3 R, 178.1 R, 236

(56) References Cited

U.S. PATENT DOCUMENTS

| | | | | |
|---|---|---|---|---|
| 59,553 | * | 11/1866 | Cabell | 160/236 |
| 1,590,886 | | 6/1926 | Carella . | |
| 1,616,385 | | 2/1927 | Metcalf . | |
| 2,110,145 | | 3/1938 | Loehr | 156/17 |
| 2,118,134 | * | 5/1938 | Allison | 160/236 |
| 2,130,319 | * | 9/1938 | Hammer | 160/236 |
| 2,155,985 | * | 4/1939 | Waterman | 160/236 |
| 2,220,064 | | 11/1940 | Clark | 156/17 |
| 2,315,605 | | 4/1943 | Ehrenfeld | 160/114 |
| 2,318,525 | | 5/1943 | Renton | 160/173 |
| 2,325,003 | | 7/1943 | Beckwith | 160/173 |
| 2,410,549 | | 11/1946 | Olson | 160/34 |
| 2,633,191 | | 3/1953 | Curtis | 160/176 |
| 3,170,505 | | 2/1965 | Lorentzen | 160/176 |
| 4,799,526 | | 1/1989 | Reeves | 160/168.1 |
| 4,818,590 | * | 4/1989 | Prince et al. | 428/213 |
| 5,409,050 | * | 4/1995 | Hong | 160/168.1 |
| 5,423,367 | | 6/1995 | Kataoka et al. | 160/168.1 |
| 5,558,146 | | 9/1996 | Abe | 160/176.1 |
| 5,573,051 | * | 11/1996 | Judkins | 160/168.1 |
| 5,957,183 | * | 9/1999 | Prince | 160/168.1 |

FOREIGN PATENT DOCUMENTS

| | | | | |
|---|---|---|---|---|
| 25126 | * | 11/1904 | (GB) | 160/236 |

* cited by examiner

*Primary Examiner*—Bruce A. Lev
(74) *Attorney, Agent, or Firm*—Rudolf O. Siegesmund

(57) ABSTRACT

A blind with angled slats where the sides are of unequal length allowing light transmission in the open and intermediate positions, no light transmission in the closed position and a flush planar surface in the closed position.

8 Claims, 2 Drawing Sheets

BLIND WITH ANGLED SLATS HAVING UNEQUAL WINGS

FIELD OF THE INVENTION

The present invention relates to Venetian blinds with angled slats in general and, in particular, to angled slats having unequal wings with circular holes for receiving cords located near the edge of the short wing of the slat for the purpose of allowing maximum light transmission in the open and intermediate positions and minimum light transmission in the closed position while further providing a flush planar surface in the closed position.

BACKGROUND OF THE INVENTION

The prior art contains angled blinds with equal wings, an apex at the junction of the wings and slots that pass through the apex and continue toward the respective edges of both wings or one wing or the other only. Common elements in prior art blinds are a head box, ladder-shaped supporting cords for supporting the slats and for tilting the slats and a bottom rail connected to lifting cords connected to the bottom rail which pass though lifting cord slats and into the head box.

U.S. Pat. No. 2,633,191 to R. Curtis, Jr. discloses an angle slatted blind with slots extending from the apex toward each wing of the slat. Curtis further disclosed angled slats that when tilted to a closed position have all of the vertical sections of the slat in a common plane. Specifically, the apex (Curtis calls it the angular free edge) of each bar is brought close to the apex of the lower adjacent bar.

U.S. Pat. No. 4,799,526 to John R. Reeves discloses a blind using angled shaped slats with lifting cord holes that are in the apex and extend only slightly beyond the apex into the respective slat wings. Reeves further discloses a blind that can be tilted so that all of the first sections are in the same vertical plane or alternatively all of the second sections are in the same vertical plane.

U.S. Pat. No. 5,423,367 to Mamoru Kataoka, et. al discloses an angle shaped slat with a slot that includes the apex and extends from the apex toward the edge of only one wing of the slat. The '367 slats specifically overlap in the vertical position in order to prevent the leakage of light from the slot.

Angled shaped slats have the advantage of giving structural rigidity to the slat so that no more than two (in normal windows) lifting cords and two ladder shaped supporting cords are necessary. The advent of new lightweight materials such as polyvinyl chloride foam and pressed bamboo create opportunities for designing blinds that are relatively thin and lightweight while having aesthetic appeal. Blind slats made from such lightweight materials require additional structural rigidity that can be easily obtained by means of an angle shape. An additional reason for the angle shape is that lifting cords and ladder shaped supporting cords detract from the blinds appearance and cost more in materials and time to assemble. Angle shaped slats are known in the prior art; however, both wings of the angle shaped slats are equal in the prior art blinds. The prior art angle shaped blind will transmit less light than a conventional blind because of the large profile presented when in intermediate or open positions. Thus, it is usual for prior art blinds to have one wing of the angle shaped blind made from light transmitting material. When the light transmitting wing of the angle shaped slat is in the vertical position, light passes through; however, one cannot see completely through the blind as with a conventional blind. When the non-light transmitting wing of the blind is in the vertical position, light will leak through the slots unless the blinds overlap to cover the slot. Therefore, there is no design in the prior art to take advantage of the new lightweight materials that can also maximize transmission of natural light while achieving a smooth planar surface when closed with no leakage of light through slats.

Therefore, a need exists for an angle shaped slat that can provide the advantages of the strength of the angle shape, allow viewing through the blinds when open, have the aesthetically desirable effect of a smooth planar surface facing into the room when closed by having all of the vertical sections in the same plane and preventing light leakage through the holes when closed.

SUMMARY OF THE INVENTION

The present invention meets the needs identified above by having an angle shaped slat with one long wing and one short wing, and circular holes for receiving cords located near the outside edge of the short wing of the slat. In this way the long wings of the slats will be in the same vertical plane when the blind is closed. In an intermediate position light can pass in increasingly greater degrees reaching a maximum when the long wing is horizontal. Leakage of light through the holes does not occur because in the closed position the long wing in the vertical plane will approach the apex of the slat beneath it, and the hole of the lower slat will be well above the end of the long wing of the higher slat. Therefore, the angle shaped slat with unequal wings and round holes meets the needs beyond the prior art by providing both aesthetic and functional capabilities that cannot be achieved by any one of the prior art blinds alone.

The foregoing and other objects, features and advantages of the invention will be apparent from the following more particular description of a preferred embodiment of the invention, as illustrated in the accompanying drawing wherein like reference numbers represent like parts of the invention.

DETAILED DESCRIPTION

Figure 1:
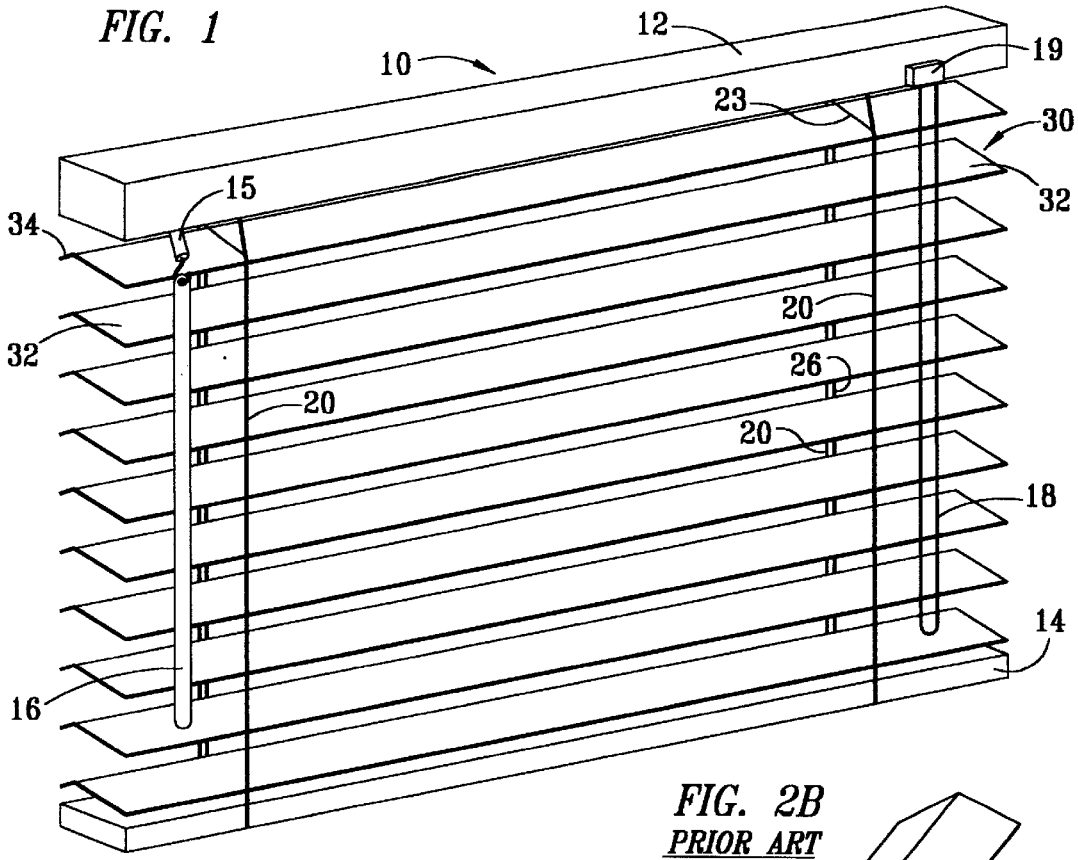
FIG. 1 is a perspective view of the invention.

FIG. 1 shows the assembled blind 10 made up of box 12, ladder 20, slat 30, lifting cord 26 and bottom rail 14. Also shown are the crank arm 15, the handle 16 and the drawstring 18 and the drawstring runner 19. Holes 36 for the lifting cords cannot be seen in this front perspective view (See FIGS. 3, 4 and 5). The gear mechanisms located within box 12 are well known to persons skilled in making Venetian blinds and are not shown. Blind 10 is operated by pulling drawstring 18 to release the blinds and letting them fall to full extension (shown) and then grasping handle 16 and turning it in order to rotate lever arm 15 which will cause ladders 20 to tilt further causing slats 30 to tilt.

Figure 2B:
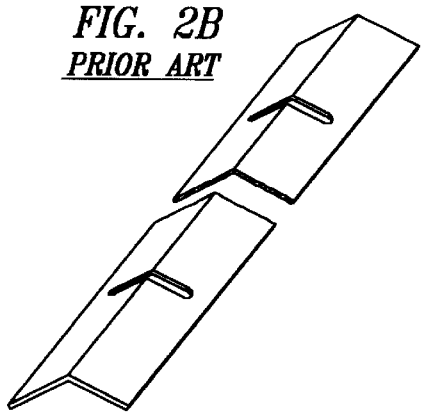
FIG. 2B PRIOR ART
FIG. 2B is a perspective view of a portion of prior art angle shaped slat with slots extending from the apex toward both edges of the slat.
Figure 2A:
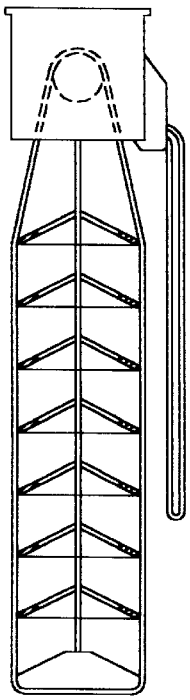
FIG. 2A PRIOR ART
FIG. 2A is an end view of equal winged prior art blinds.
Figure 2C:
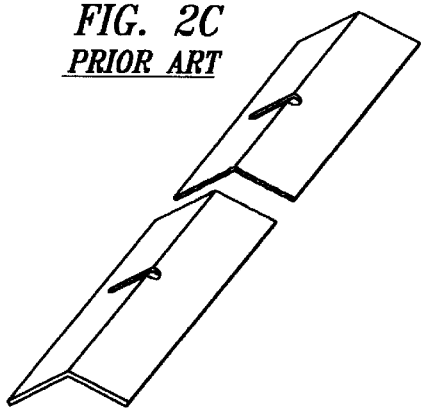
FIG. 2C PRIOR ART
FIG. 2C is a perspective view of a portion of prior art angle shaped slat with slots extending from the apex toward one edge only of the slat.

FIGS. 2A, 2B and 2C show prior art blinds with angle shaped slats with equal wings and slots extending from the apex either in both directions toward the outside edge of the prior art slat (FIG. 2B) or from the apex toward only one outside edge of the prior art slat (FIG. 2C).

Figure 3:
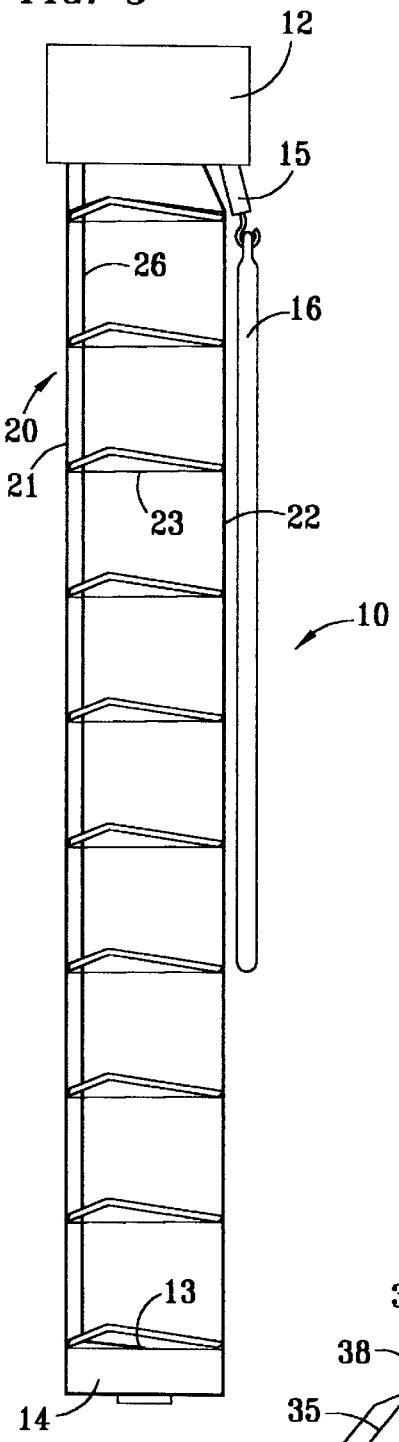
FIG. 3 is a side view of the invention with the slats of the blind in full open position

FIG. 3 depicts blind 10 viewed from the side. Blind 10 is oriented so that long wing 31 of slat 30 is pointing into the room and toward a person inside a room looking out through the blinds (not shown). Lifting cord 20 is hanging fully extended and without tilting. Cord 26 is fully extended and runs from box 12 through holes 36 to rail 14 where it is anchored to rail 14 at point 13. In FIG. 3, an end view of slat 30 can be seen with long wing 31 and short wing 32. In the preferred embodiment, slat 30 is made of polyvinyl chloride foam. Other embodiments of slat 30 can be made from polyvinyl chloride, polypropylene, plastic, polyurethane or pressed bamboo. However, slat 30 can be made from any suitable material. Short wing 32 has hole 36 for receiving cord 26. The diameter of hole 36 is greater than the diameter of cord 26 in order to ensure free passage of cord 26 through hole 36. In the preferred embodiment, the diameter of hole 36 is 0.125 inch; however, the diameter can be any size sufficient to ensure the free passage of cord 26. Ladder 20 has front 22, rear 21 and support 23. Slat 30 rests on support 23 at the junction of support 23 with front 22 and rear 21.

Figure 4:
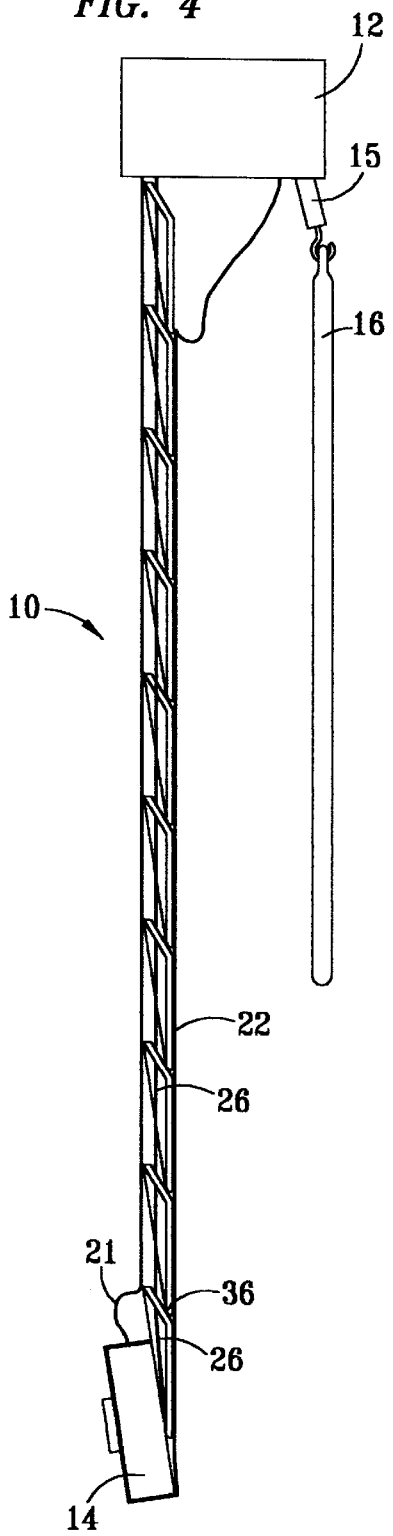
FIG. 4 is a side view of the invention with the slats of the blind in full closed position.

FIG. 4 shows blind 10 in the closed position. Ladder 20 has been tilted so that front 22 drops and rear 21 rises with the result that long wing 31 of slat 30 tilts downward and short wing 32 of slat 30 tilts upward. Ladder 20 has been tilted so that front wing 31 is vertical and front edge 39 rests on the junction of front 22 and support 23 of ladder 20. Edge 39 of long wing 31 may either touch short wing 32 or hang a short distance above short wing 32; however, edge 39 does not extend beyond apex 35.

Figure 5:
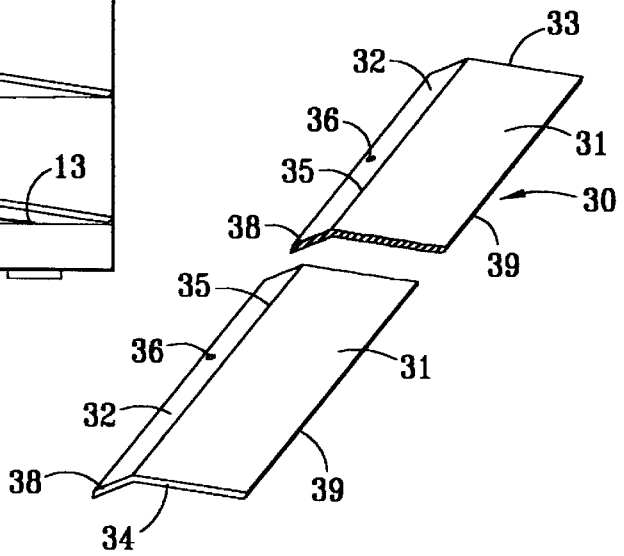
FIG. 5 is a perspective of the angle shaped slat with unequal sides and holes

In FIG. 5, slat 30 is shown in a shortened view. Slat 30 has long wing 31 and short wing 32 which meet at apex 35. Slat 30 further has holes 36, right edge 33, left edge 34, front edge 39 and rear edge 38. In the preferred embodiment, the interior angle at the junction of short wing 32 and long wing 31 at apex 35 is 150°. Experimentation has shown that 150° is the optimum angle for the interior angle between long wing 31 and short wing 32. A variation of ±20° is acceptable. Therefore, the interior angle z defined by the junction of long wing 31 and short wing 32 meeting at apex 35 is in the range from 130° to 170° ($130° \leqq z \leqq 170°$). Experimentation has shown that the optimum width of short wing 32 measured from rear edge 38 to apex 35 is 0.35 times the width of long wing 31 measured from front edge 39 to apex 35. If x=width of long wing 31 and y=width of short wing 32, then the respective widths are defined as y=0.35x. Therefore, the range of values defining the width of short wing 32 where x=the width of long wing 31 and y=the width of short wing 32 is y is less than or equal to 0.40x and y is greater than or equal to 0.30x.

Holes 36 are located in short wing 32. If short wing 32 were divided in half lengthwise by an imaginary line running down the middle parallel to apex 35, then the geometric center of the circles defined by of holes 36 would lie within the half of short wing 32 which is the outside half or the side having edge 38. In the preferred embodiment, slat 30 is 23 inches long and the geometric center of the circles defined by holes 36 are located 5 inches from right edge 33 and from left edge 34. For other embodiments, the location of holes 36 can be defined as follows. If L is the length of slat 30, then the geometric center of the circles defined by holes 36 will be located at a distance from right edge 33 and left edge 34 defined by 0.22 L. The range of the location can vary from 0.18 L to 0.26 L. Where y is the width of short wing 32, then the geometric center of the circles defined by holes 36 will not be any nearer rear edge 38 than 0.25y and not closer to apex 35 than 0.50y.

If hole 36 is too close to the edge then the material may break. Moreover, if holes 36 are too close to the apex then the advantageous effect of the unequal wings will not be achieved. In addition to allowing a flat planar surface when in the full closed position, slat 30 achieves a uniformity of spacing so that the slats at the bottom are evenly vertical like the slats at the top. Furthermore, in intermediate positions, where the slats are open up to the full horizontal position for long wings 31, there will be no aggregation of space caused by lifting cords 26 because lifting cords 26 do not move forward within a slot but remain positioned in the rear half of short wing 32. Therefore, the angle of tilt of slats 30 near rail 14 will be very close or similar to the angle of tilt for slats 30 near box 12. An difference in the angle of tilt going in slats 30 due to contact of lifting cords 26 with the forward edge of a slat is avoided.

It will be understood from the foregoing description that various modifications and changes may be made in the preferred embodiment of the present invention without departing from its true spirit. It is intended that this description is for purposes of illustration only and should not be construed in a limiting sense. The scope of this invention should be limited only by the language of the following claims.

What is claimed is:

1. A slat for a blind comprising: a long wing and a short wing fixedly engaged at an apex; a left edge, a right edge, a length, a short wing edge parallel to said apex, a short wing width, said short wing having a first hole and a second hole;

wherein said short wing and said long wing form an interior angle between 130 degrees and 170 degrees at said apex;

wherein said first hole is located in a first direction perpendicular to said left edge at a first distance between 18 percent to 26 percent of said length and said second hole is located in a second direction perpendicular to said right edge at said first distance; and, wherein said first hole is located in a third direction perpendicular to said short wing edge at a second distance between 25 percent and 50 percent of said short wing width and said second hole is located in a third direction perpendicular to said short wing edge at said second distance so that when said slats are in a full closed position said long wings will be evenly vertical and when said long wings are horizontal there will be no aggregation of space caused by said right lifting cord and said left lifting cord.

2. The slat of claim 1 wherein the slat is made from one of the group of materials consisting of: polyvinyl chloride foam, polyvinyl chloride, polypropylene, plastic and pressed bamboo.

3. A blind comprising a box;

a rail;

a left cord and a right cord connected to said box and said rail;

a plurality of slats each having a long wing and a short wing fixedly joined at an apex defining an interior angle between 130 degrees and 170 degrees, said short wing having a first hole for receiving said right cord and a second hole for receiving said left cord; wherein said right cord is fixedly engaged to said rail and passes through said first hole and is movably engaged to said box and said left cord is fixedly engaged to said rail and passes through said second hole and is movably engaged to said box; and a plurality of ladders connected to said box and said rail supporting said plurality of slats.

4. The blind of claim 3 wherein the slat is made from one of the group of materials consisting of: polyvinyl chloride foam, polyvinyl chloride, polypropylene, plastic and pressed bamboo.

5. The blind of claim 4 wherein, each of said slats has a length, a right end, a left end, a short wing width parallel to said apex, and a short wing width; and said first hole for receiving said right lifting cord is positioned in a direction perpendicular to said right end at a first distance from said right end between 26 percent of said length and 18 percent of said length and further wherein said second hole for receiving said left lifting cords is positioned in a second direction perpendicular to said left end at said first distance from said left end;

wherein said first hole is located in a third direction perpendicular to said short wing edge at a second distance between 25 percent and 50 percent of said short wing width and said second hole is located in a third direction perpendicular to said short wing edge at said second distance; and wherein the width of said short wing is in the range equal to or less than forty percent of the width of said long wing and greater than or equal to thirty percent of said width of said long wing so that when said slats are in a full closed position said long wings will be evenly vertical and when said long wings are horizontal there will be no aggregation of space caused by said right lifting cord and said left lifting cord.

6. The blind of claim 5 wherein the slat is made from one of the group of materials consisting of: polyvinyl chloride foam, polyvinyl chloride, polypropylene, plastic and pressed bamboo.

7. The blind of claim 5 wherein the width of said short wing is equal to or less than forty percent of the width of said long wing and is greater than or equal to thirty percent of said width of said long wing.

8. A blind for a door or window of a house or building, said door or window having an inside and an outside, said blind having a box containing a lifting and tilting mechanism, a rail, a right supporting ladder connected to said rail and to said tilting mechanism, a left supporting ladder connected to said rail and to said tilting mechanism, a right lifting cord connected to said rail and to said lifting mechanism and a left lifting cord connected to said rail and to said lifting mechanism, said blind comprising:

a plurality of slats, each of said slats having a short wing and a long wing fixedly connected at an apex said short wing further having a right hole for receiving said right lifting cord and a left hole for receiving said left lifting cord;

wherein said first hole is located in a first direction perpendicular to said left edge at a first distance between 18 percent to 26 percent of said length and said second hole is located in a second direction perpendicular to said right edge at said first distance, wherein said first hole is located in a third direction perpendicular to said short wing edge at a second distance between 25 percent and 50 percent of said short wing width and said second hole is located in a third direction perpendicular to said short wing edge at said second distance, wherein each of said slats is suspended horizontally by said right supporting ladder and said left supporting ladder;

wherein said right lifting cord passes through each of said first holes;

wherein said left lifting cord passes through each of said second holes;

wherein the junction of said long wing and said short wing at said apex defines an interior angle between 130 degrees and 170 degrees; and wherein the width of said short wing is equal to or less than forty percent of the width of said long wing and is greater than or equal to thirty percent of said width of said long wing so that when said slats are in a full closed position said long wings will be evenly vertical and when said long wings are horizontal there will be no aggregation of space caused by said right lifting cord and said left lifting cord.

* * * * *